US009341988B2

(12) United States Patent
Funatani et al.

(10) Patent No.: US 9,341,988 B2
(45) Date of Patent: May 17, 2016

(54) IMAGE FORMING APPARATUS

(71) Applicant: CANON KABUSHIKI KAISHA, Tokyo (JP)

(72) Inventors: Kazuhiro Funatani, Mishima (JP); Tetsuichiro Fujimoto, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/501,819

(22) Filed: Sep. 30, 2014

(65) Prior Publication Data

US 2015/0093143 A1 Apr. 2, 2015

(30) Foreign Application Priority Data

Oct. 1, 2013 (JP) ..... 2013-206802

(51) Int. Cl.
*G03G 15/16* (2006.01)
*G03G 21/12* (2006.01)

(52) U.S. Cl.
CPC ..... *G03G 15/161* (2013.01); *G03G 21/12* (2013.01)

(58) Field of Classification Search
USPC ..... 399/99–101
See application file for complete search history.

(56) References Cited

U.S. PATENT DOCUMENTS 5,649,272 A * 7/1997 Kwon ..... G03G 15/1635 399/297
6,175,702 B1 * 1/2001 Takeuchi ..... G03G 15/0131 399/101
6,667,140 B2 * 12/2003 Tosaka ..... G03G 5/0609 430/108.23
6,697,581 B2 * 2/2004 Ohtani ..... G03G 15/161 399/101
6,985,678 B2 * 1/2006 Maebashi ..... G03G 15/0131 399/39
7,376,374 B2 * 5/2008 Adachi ..... G03G 15/0844 399/119
8,270,855 B2 * 9/2012 Yagi ..... G03G 15/0131 399/27
8,290,385 B2 * 10/2012 Nakagawa ..... G03G 21/0047 399/101
2009/0232530 A1 9/2009 Saito et al.
2014/0168670 A1 6/2014 Ichinose et al.
2014/0169821 A1 6/2014 Ichinose et al.

FOREIGN PATENT DOCUMENTS

JP 2005-025010 A 1/2005
JP 2005-316268 A 11/2005
JP 2009-205012 A 9/2009
JP 2009-288481 A 12/2009
JP 2012-123104 A 6/2012

* cited by examiner

*Primary Examiner* — Clayton E Laballe
*Assistant Examiner* — Warren K Fenwick
(74) *Attorney, Agent, or Firm* — Fitzpatrick, Cella, Harper & Scinto

(57) ABSTRACT

An image forming apparatus includes an image bearing member; an intermediary transfer member; a controller; and a cleaning unit. The cleaning unit includes a cleaning member for collecting a residual toner in contact with the intermediary transfer member, a charging member, which is provided downstream of the cleaning member with respect to a movement direction of the intermediary transfer member, for electrically charging the residual toner, and an accommodating member for accommodating the residual toner. The controller is capable of executing an operation in a discharging mode in which the toner is discharged from the charging member onto the intermediary transfer member. When the operation in the discharging mode is executed, the cleaning unit collects the toner, discharged from the charging member on the intermediary transfer member, by the cleaning member and then accommodates the collected toner in the accommodating member.

12 Claims, 7 Drawing Sheets

IMAGE FORMING APPARATUS

FIELD OF THE INVENTION AND RELATED ART

The present invention relates to an image forming apparatus, such as a copying machine or a printer, of an electrophotographic or electrostatic recording type employing an intermediary transfer type in which a toner image formed on an image bearing member is transferred onto an intermediary transfer member and thereafter is transferred onto a transfer material (recording material).

As the image forming apparatus such as the copying machine or the printer, an image forming apparatus having a constitution using the intermediary transfer member has been conventionally known.

In this image forming apparatus, as a primary-transfer step, the toner image formed on a photosensitive drum is transferred onto the intermediary transfer member by a primary-transfer unit. Thereafter, the primary-transfer step is repetitively executed with respect to the toner images for a plurality of other colors, whereby the toner images for the plurality of colors are superposedly formed on a surface of the intermediary transfer member are collectively transferred onto a surface of the transfer material such as paper by a secondary-transfer unit. The transfer material on which the toner images are collectively transferred is thereafter permanently formed by a fixing unit, so that a full-color image is formed.

As a cleaning method of a residual toner remaining on the intermediary transfer member without being transferred onto the transfer material after the secondary-transfer step, Japanese Laid-Open Patent Application (JP-A) 2005-316268 discloses a constitution in which blade cleaning and charging cleaning are used in combination.

Specifically, in JP-A 2005-316268, a constitution in which a blade member and a charging member provided downstream of the blade member with respect to a rotational direction of the intermediary transfer member are provided is disclosed. In the constitution of JP-A 2005-316268, the residual toner which cannot be scraped off by the blade member is collected into a brush member by electrically charging the residual toner by the charging member. Further, a part of the residual toner is charged by the charging member and is moved from the intermediary transfer member onto the image bearing member, so that the residual toner is removed from the surface of the intermediary transfer member. By this constitution, the residual toner remaining on the intermediary transfer member without being collected by the blade member can be removed from the intermediary transfer member.

In the case where the charging member is employed, the residual toner is deposited on the charging member during cleaning, and therefore a charging efficiency by the charging member is gradually lowered. For that reason, there is a need to periodically remove the residual toner deposited on the charging member. As a method of removing the residual toner, a method in which a voltage of an opposite polarity to a polarity when the residual toner is charged is applied to the charging member would be considered. The residual toner discharged from the charging member onto the intermediary transfer member by the voltage of the opposite polarity is moved from the intermediary transfer member to the photosensitive drum, and then is collected by a photosensitive drum cleaning unit.

However, when the residual toner discharged from the charging member is collected by the photosensitive drum cleaning unit, there arises a problem that the photosensitive drum cleaning unit is upsized.

Further, on an intermediary transfer belt, in addition to the residual toner, paper powder is generated by contact with the transfer material, and therefore when the residual toner is moved to the photosensitive drum, there is a case where also the paper powder is moved to the photosensitive drum. As a result, there is a liability that the photosensitive drum is damaged.

SUMMARY OF THE INVENTION

A principal object of the present invention is, in view of the above-described circumstances, to provide an image forming apparatus capable of achieving cleaning of an intermediary transfer member in which a degree of damage on an image bearing member is reduced while ensuring a cleaning property.

According to an aspect of the present invention, there is provided an image forming apparatus comprising: an image bearing member for bearing a toner image; an intermediary transfer member which is movable and onto which the toner image is to be primary-transferred from the image bearing member at a primary transfer portion; a controller; and a cleaning unit for removing a residual toner remaining on the intermediary transfer member without being secondary-transferred from the intermediary transfer member onto a transfer material at a secondary transfer portion, wherein the cleaning unit includes a cleaning member for collecting the residual toner in contact with the intermediary transfer member, a charging member, which is provided downstream of the cleaning member with respect to a movement direction of the intermediary transfer member, for electrically charging the residual toner, and an accommodating member for accommodating the residual toner, wherein the controller is capable of executing an operation in a discharging mode in which the toner is discharged from the charging member onto the intermediary transfer member, and wherein when the operation in the discharging mode is executed, the cleaning unit collects the toner, discharged from the charging member on the intermediary transfer member, by the cleaning member and then accommodates the collected toner in the accommodating member.

According to another aspect of the present invention, there is provided an image forming apparatus comprising: a plurality of image bearing members each for bearing a toner image; an intermediary transfer member which is movable and onto which the toner image is to be primary-transferred from each of the plurality of image bearing members at a primary transfer portion; a controller; and a cleaning unit for removing a residual toner remaining on the intermediary transfer member without being secondary-transferred from the intermediary transfer member onto a transfer material at a secondary transfer portion, wherein the cleaning unit includes a cleaning member for collecting the residual toner in contact with the intermediary transfer member, a charging member, which is provided downstream of the cleaning member with respect to a movement direction of the intermediary transfer member, for electrically charging the residual toner, and an accommodating member for accommodating the residual toner, wherein the controller is capable of executing an operation in a discharging mode in which the toner is discharged from the charging member onto the intermediary transfer member, and wherein when the operation in the discharging mode is executed, the intermediary transfer member is rotated in a state in which the plurality of image bearing members and the intermediary transfer member are separated from each other, and the toner discharged from the charging member on the intermediary transfer member is collected, by the cleaning member and then the toner is accommodated in the accommodating member.

These and other objects, features and advantages of the present invention will become more apparent upon a consideration of the following description of the preferred embodiments of the present invention taken in conjunction with the accompanying drawings.

DESCRIPTION OF THE EMBODIMENTS

An image forming apparatus according to the present invention will be described specifically with reference to the drawings.

Embodiment 1

Structure and Operation of Image Forming Apparatus

Figure 1:
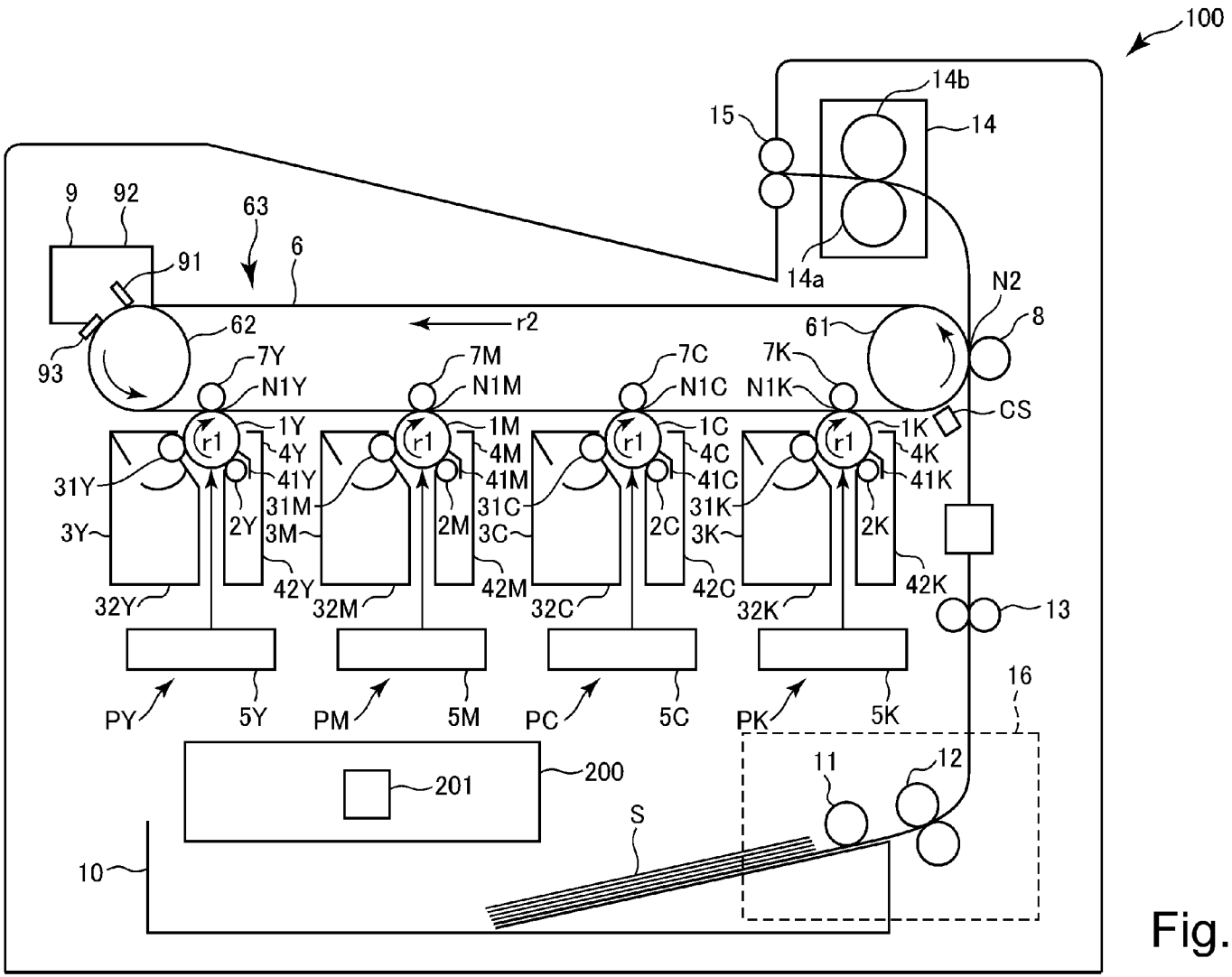
FIG. 1 is a schematic sectional view for illustrating an embodiment of an image forming apparatus according to the present invention.
Figure 2:
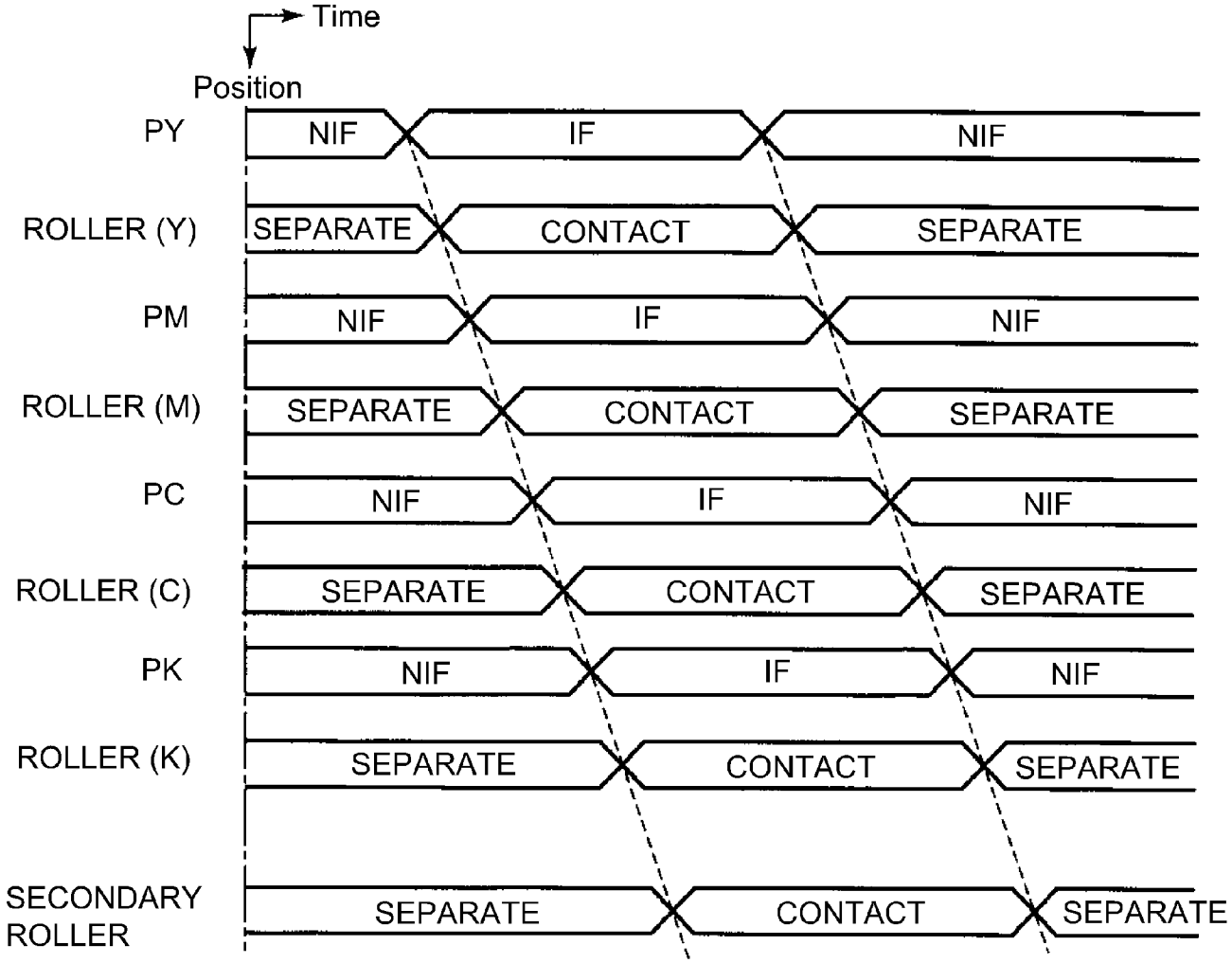
FIG. 2 is a timing chart for illustrating a contact-and-separation timing of each of a primary-transfer portion and a secondary-transfer portion in this embodiment.

FIG. 1 is a schematic sectional view showing an embodiment of an image forming apparatus 100 according to the present invention. FIG. 2 is an operation sequence of the image forming apparatus 100 in this embodiment. With reference to FIGS. 1 and 2, a structure and operation of the image forming apparatus 100 in this embodiment will be described.

The image forming apparatus 100 is a 4-drum type full-color image forming apparatus including an intermediary transfer member, and including process cartridges P (PY, PM, PC, PK) detachably mountable to the image forming apparatus. These four process cartridges PY, PM, PC, PK have the same structure. A difference therebetween is that images with toners, of yellow (Y), magenta (M), cyan (C), black (K), accommodated in the process cartridges PY, PM, PC, PK, respectively, are formed. The contacts PY, PM, PC, PK include photosensitive drums 1Y, 1M, 1C, 1K, respectively, which are electrophotographic photosensitive members as image bearing members.

At peripheries of the photosensitive drums 1Y, 1M, 1C, 1K, charging rollers 2Y, 2M, 2C, 2K which are charging units, developing units 3Y, 3M, 3C, 3K and photosensitive drum cleaning units 4Y, 4M, 4C, 4K are provided. The developing units 3Y, 3M, 3C, 3K include toner containers 32Y, 32M, 32C, 32K applying the toner of the respective colors. The photosensitive drum cleaning units 4Y, 4M, 4C, 4K include photosensitive drum cleaning blades 41Y, 41M, 41C, 41K and waste toner (residual toner) containers 42Y, 42M, 42C, 42K. At a lower portion of the process cartridges PY, PC, PC, PK, laser units 5Y, 5M, 5C, 5K which are exposure units are provided.

In the image forming apparatus 100, an intermediary transfer belt 6 which is an endless belt-shaped intermediary transfer member capable of being rotated and moved along contact positions with the respective photosensitive drums 1 is provided. The intermediary transfer belt 6 is stretched by a driving roller 61 and a tension roller 62, and constitutes an intermediary transfer belt unit 63. Inside the intermediary transfer belt 6, primary-transfer rollers 7Y, 7M, 7C, 7K are provided opposed to the photosensitive drums 1Y, 1M, 1C, 1K. In the neighborhood of the driving roller 61, a color misregistration detecting sensor CS is provided in an outer peripheral surface side of the intermediary transfer belt 6. Further, at a position opposing the driving roller 61 via the intermediary transfer belt 6, a secondary-transfer roller 8 which is a secondary-transfer unit is provided. Further, at a position opposing the tension roller 62 via the intermediary transfer belt 6, an intermediary transfer belt cleaning unit 9 is provided.

At an inner lower portion of the image forming apparatus 100, a paper (sheet)-feeding cassette 10 for accommodating a transfer material (recording material) S is provided. A feeding device 16 for feeding the transfer material S from the paper feeding cassette 10 includes a paper feeding roller 11 and a feeding roller pair 12. Further, with respect to a feeding direction of the transfer material S, the image forming apparatus 100 includes a registration roller pair 13, the secondary-transfer roller 8, a fixing unit 14 and a discharging roller pair 15.

The surfaces of the photosensitive drums 1Y, 1M, 1C, 1K are electrically charged uniformly to a predetermined negative potential by applying a predetermined negative voltage to the charging rollers 2Y, 2M, 2C, 2K. Thereafter, on the basis of image signals, separated into color components, sent from an unshown host computer or image reader, the surfaces of the photosensitive drums 1Y, 1M, 1C, 1K are exposed to light by the laser units 5Y, 5M, 5C, 5K, so that electrostatic latent images are formed on the photosensitive drums 1Y, 1M, 1C, 1K. The electrostatic latent images are reversely developed with the toners accommodated in the toner containers 32Y, 32M, 32C, 32K by applying a predetermined negative voltage to the developing rollers 31Y, 31M, 31C, 31K, so that toner images of the respective colors are formed on the photosensitive drums 1Y, 1M, 1C, 1K. The toners used in this embodiment are negatively charged.

Further, the primary-transfer rollers 7Y, 7M, 7C, 7K disposed inside the intermediary transfer belt 6 so as to oppose the photosensitive drums 1Y, 1M, 1C, 1K are constituted so that a primary-transfer voltage is applied thereto from an unshown voltage applying unit.

Further, by the color misregistration detecting sensor CS which is an optical sensor, a toner pattern, for calibration, formed on the intermediary transfer belt 6 is detected.

The photosensitive drums 1Y, 1M, 1C, 1K are rotated in arrow r1 directions in FIG. 1, and the intermediary transfer belt 6 is rotated in an arrow r2 direction, and then a positive voltage is applied to the primary-transfer rollers 7Y, 7M, 7C, 7K at predetermined timing. As a result, the toner images formed on the photosensitive drums 1Y, 1M, 1C, 1K are successively primary-transferred onto the intermediary transfer belt 6 at primary-transfer portions N1Y, N1M, N1C, N1K. The toner images are successively primary-transferred onto the intermediary transfer belt 6 from the toner image on the photosensitive drum 1Y, and superposed toner images in a superposed state of the four color toner images are fed to the secondary-transfer roller 8 positioned at a secondary-transfer portion N2.

In this embodiment, the photosensitive drums 1Y, 1M, 1C, 1K and the primary-transfer rollers 7Y, 7M, 7C, 7K are constituted so that the primary-transfer rollers are moved toward and away from the photosensitive drums via the intermediary transfer belt 6. Further, the secondary-transfer roller 8 is also constituted so as to be moved toward and away from the intermediary transfer belt 6. These contactable and separable constitutions are such that a contact-and-separation state in which the primary-transfer rollers 7Y, 7M, 7C, 7K are moved toward and away from the photosensitive drums 1Y, 1M, 1C, 1K and a contact-and-separation state in which the secondary-transfer roller are arbitrarily changeable.

Further, in this embodiment, as shown in an operation sequence of a diagram of FIG. 2, depending on an image forming secondary-transfer of each of the process cartridges PY, PM, PC, PK, the photosensitive drums 1Y, 1M, 1C, 1K are successively contacted to and separated (spaced) from the intermediary transfer belt 6. This is because abrasion of the photosensitive drums 1Y, 1M, 1C, 1K is suppressed.

Further, in this embodiment, also the secondary-transfer roller 8 is contactable to and separable from the intermediary transfer belt 6.

The operation sequence shown in FIG. 2 shows an electrostatic latent image forming state at each of the process cartridges PY, PM, PC, PK, a contact-and-separation state of each of the primary-transfer rollers 7Y, 7M, 7C, 7K, and a contact-and-separation state of the secondary-transfer roller 8. The operation sequence of FIG. 2 is as follows in the order from above to below. The first row shows the electrostatic latent image forming state of the process cartridge PY. The second row shows the contact-and-separation state of the primary-transfer roller 7Y. The third row shows the electrostatic latent image forming state of the process cartridge PM. The fourth row shows the contact-and-separation state of the secondary-transfer roller 7M. The fifth row shows the electrostatic latent image forming state of the process cartridge PC. The sixth row shows the contact-and-separation state of the primary-transfer roller 7C. The seventh row shows the electrostatic latent image forming state of the process cartridge PK. The eighth row shows the contact-and-separation state of the primary-transfer roller 7K. The ninth row shows the contact-and-separation state of the secondary-transfer roller 8. The electrostatic latent image formed at each of the process cartridges P is developed into the toner image, and at timing when the toner image is primary-transferred onto the intermediary transfer belt 6, the associated one of the primary-transfer rollers 7 is contacted to the intermediary transfer belt 6 toward the associated photosensitive drum 1. When the primary-transfer is ended, the primary-transfer rollers 7 are successively separated from the intermediary transfer belt 6 and the photosensitive drums 1. By this operation, a contact time of each of the primary-transfer rollers 7 with the intermediary transfer belt 6 toward the photosensitive drums 1 is reduced, so that a deterioration of the photosensitive drums 1 is suppressed to the possible extent.

The feeding device 16 includes the feeding roller 11 for feeding the transfer material S from the feeding cassette 10 accommodating the transfer material S, and the feeding roller pair 12 for feeding the fed transfer material S. Then, the transfer material S fed from the feeding device 16 is fed by the registration roller pair 13 to the secondary-transfer roller 8 positioned at the secondary-transfer portion N2 by being timed to the toner image on the intermediary transfer belt 6. In order to transfer the toner image from the intermediary transfer belt 6 onto the transfer material S at the secondary-transfer portion N2, a positive voltage is applied to the secondary-transfer roller 8. As a result, the toner image is secondary-transferred from the intermediary transfer belt 6 onto the fed transfer material S. The transfer material S on which the toner image is transferred is fed into the fixing unit 14 and is heated and pressed by a fixing film 14*a* and a pressing roller 14*b*, so that the toner image is fixed on the surface on the transfer material S. The transfer material S on which the toner image is fixed is discharged by a discharging roller pair 15.

After the toner image is transferred onto the transfer material S, a primary-transfer residual toner remaining on the surfaces of the photosensitive drums 1Y, 1M, 1C, 1K without being primary-transferred onto the intermediary transfer belt 6 is removed by the photosensitive drum cleaning blades 41Y, 41M, 41C, 41K. The removed toner is accommodated in the waste toner (residual toner) containers 42Y, 42M, 42C, 42K.

Most of the residual toner remaining on the intermediary transfer belt (intermediary transfer member) 6 without being secondary-transferred onto the transfer material S is scraped off by a blade 91 which is a first cleaning member of the intermediary transfer belt cleaning unit 9. Then, the residual toner is collected in an accommodating member 92 which is a toner accommodating container for the scraped-off toner. The intermediary transfer belt cleaning unit 9 is provided at a position opposing the tension roller 62 via the intermediary transfer belt 6, and is disposed downstream of the secondary-transfer portion N2 and upstream of the primary-transfer portions N1Y, N1M, N1C, N1K with respect to a rotational movement direction of the intermediary transfer belt 6. Further, the toner slipped through the blade 91 in a slight amount (hereinafter, referred to as a "slip-through toner") is collected by an auxiliary cleaning member 92 which is a second cleaning member provided, in the intermediary transfer belt cleaning unit 9, downstream of the blade 91 with respect to the rotational movement direction of the intermediary transfer belt 6. The action of the auxiliary cleaning member 93 is a feature of the present invention, and therefore will be described later specifically.

The image forming apparatus 100 includes a control substrate 200 on which an electric circuit for effecting control is mounted. On the control substrate 200, CPU 201 as a controller is mounted. The CPU 201 collectively effects control of the operation of the image forming apparatus 100, such as control of a driving source (not shown) regarding the feeding of the transfer material S or a driving source (not shown) or the like of the intermediary transfer belt 6 and the process cartridges PY, PM, PC, PK, control regarding the image formation, and control regarding fault detection, and the like.

In the following the transfer constitution will be described more specifically.

(Transfer Constitution)

The intermediary transfer belt 6 is an endless belt in which an electroconductive agent is added into a resin material to impart electroconductivity thereto, and is stretched by two shafts of the driving roller 61 and the tension roller 62, and is stretched under a tension of 100N in total pressure by the tension roller 62. The intermediary transfer belt 6 is 70 μm in thickness and uses an endless belt of polyimide resin which is $1\times10^{10}$ Ω·cm in volume resistivity adjusted by mixing carbon black as the electroconductive agent. As an electrical characteristic, an electron-conductive characteristic is exhibited, and the intermediary transfer belt 6 possesses a feature such that a fluctuation in resistance value against a temperature and a humidity in ambience. A range of the volume resistivity may preferably be a range from $1\times10^{9}$ Ω·cm to $1\times10^{11}$ Ω·cm from the viewpoint of a transfer property. When the volume resistivity is lower than $1\times10^{9}$ Ω·cm, a transfer defect due to leakage of a transfer current in a high-temperature and high-humidity environment occurs. When the volume resistivity is higher than $1\times10^{11}$ Ω·cm, the transfer defect due to abnormal electric discharge in a low-temperature and low-humidity environment occurs. The volume resistivity is measured by using a device ("Hiresta-UP (MCP-HT450)", manufactured by Mitsubishi Chemical Corp.) and a measuring probe ("UR") under a condition of 23° C. in room temperature during measurement, 50% in set room humidity, 250 V in applied voltage, and 100 sec in measurement time.

In this embodiment, as the material for the intermediary transfer belt 6, polyimide resin is used, but other materials may also be used if the materials are thermoplastic resin materials. For example, materials such as polyester, polycarbonate, polyallylate, acrylonitrilebutadienestyrene copolymer (ABS), polyphenylene sulfide (PPS), polyvinylidene fluoride (PVdF) and polyethylene naphthalate (PEN) and mixed resin materials of these materials may also be used.

As each of the primary-transfer rollers 7Y, 7M, 7C, 7K, a roller which is prepared by coating a nickel-plated steel rod of 6 mm in outer diameter with a foam sponge member principally containing NBR and epichlorohydrin rubber adjusted to have the volume resistivity of $10^{7}$ Ω·cm and the thickness of 3 mm, and which has the outer diameter of 12 mm is used. The primary-transfer rollers 7Y, 7M, 7C, 7K are contacted to the intermediary transfer belt 6 toward the photosensitive drums 1Y, 1M, 1C, 1K at pressure of 9.8 N, and are rotated by rotation of the intermediary transfer belt 6. Further, when the toner images are primary-transferred from the photosensitive drums 1Y, 1M, 1C, 1K onto the transfer material S, a voltage of 1500 voltage is applied.

As the secondary-transfer roller 8, a roller which is prepared by coating a nickel-plated steel rod of 8 mm in outer diameter with a foam sponge member principally containing NBR and epichlorohydrin rubber adjusted to have the volume resistivity of $10^{8}$ Ω·cm and the thickness of 5 mm, and which has the outer diameter of 18 mm is used. Further, the secondary-transfer roller 8 is contacted to the intermediary transfer belt 6 at pressure of 50 N, and is rotated by rotation of the intermediary transfer belt 6.

A voltage source for applying a voltage to the secondary-transfer roller 8 includes a positive voltage source for carrying out the secondary-transfer onto the transfer material S such as paper and a negative voltage source for preventing toner deposition on the secondary-transfer roller 8, and these voltage sources are arbitrarily switchable. In this embodiment, a contact-and-separation mechanism for the secondary-transfer roller 8 is provided, and as shown in FIG. 2, the secondary-transfer roller 8 is contacted to the intermediary transfer belt 7 only during the image formation.

(Intermediary Transfer Belt Cleaning Unit 9)

Figure 3:
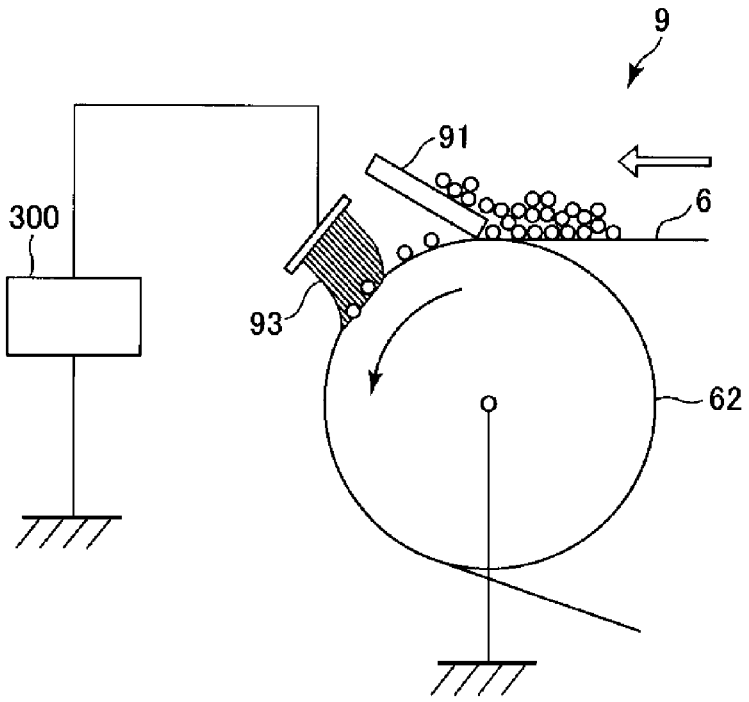
FIG. 3 is a schematic sectional view for illustrating a structure of an intermediary transfer belt cleaning unit in this embodiment.

FIG. 3 is a schematic sectional view of the intermediary transfer belt cleaning unit 9 in this embodiment. The blade 91 is formed with, e.g., an elastic member of urethane. The blade 91 is press-contacted, with respect to a counter direction against the rotational movement direction of the intermediary transfer belt 6, to the intermediary transfer belt 6 toward the tension roller 62 at linear pressure of about 0.49 N/cm. The cleaning unit 9 includes the accommodating member 92 for accommodating the residual toner to be collected by the blade 91.

The auxiliary cleaning member 92 is provided downstream of the blade with respect to the rotational movement direction of the intermediary transfer belt 6, and is press-contacted to the intermediary transfer belt 6 toward the tension roller 62. In this embodiment, as the auxiliary cleaning member 93, an electroconductive brush 93 which is a charging member is used. The electroconductive brush 93 is constituted by electroconductive fibers. The electroconductive brush 93 will be specifically described later.

The electroconductive brush 93 is constituted so that a predetermined voltage is applied thereto from a high-voltage source 300. This high-voltage source 300 and voltage control will be described later. The tension roller 62 is grounded and constitutes an opposite electrode to a voltage to be applied to the electroconductive brush 93. An output of the high-voltage source 300 is arbitrarily changeable, and depending on an output state thereof, an operation in a collecting mode for collecting the toner in the electroconductive brush 93 and an operation in a discharging mode for discharging the toner from the electroconductive brush 93 are executable, and can be arbitrarily selected and switched. In the case where a voltage of an opposite polarity to the polarity of the toner is applied to the electroconductive brush 93, the toner is electrostatically attracted to the electroconductive brush 93, so that the operation in the collecting mode for collecting the toner on the intermediary transfer belt 6 is performed. In the case where the voltage is not applied to the electroconductive brush 93, an electrostatic attraction force between the toner and the electroconductive brush 93 is weakened, so that the operation in the discharging mode for discharging the toner from the electroconductive brush 93 onto the intermediary transfer belt 6 is performed. Hereinafter, the toner discharged from the electroconductive brush 93 is referred to as a discharged toner.

When the residual toner is intended to be collected only by the electroconductive brush 93, the number of times of execution of the operation in the discharging mode for discharging the toner from the electroconductive brush 93 onto the intermediary transfer belt 6 is large, so that downtime becomes long. However, the blade 91 is disposed upstream of the electroconductive brush 93, and most of the toner on the intermediary transfer belt 6 is scraped off, and therefore it becomes possible to shorten the downtime by reducing the execution number of the operation in the discharging mode.

The electroconductive brush 93 used in this embodiment will be described.

Figure 4:
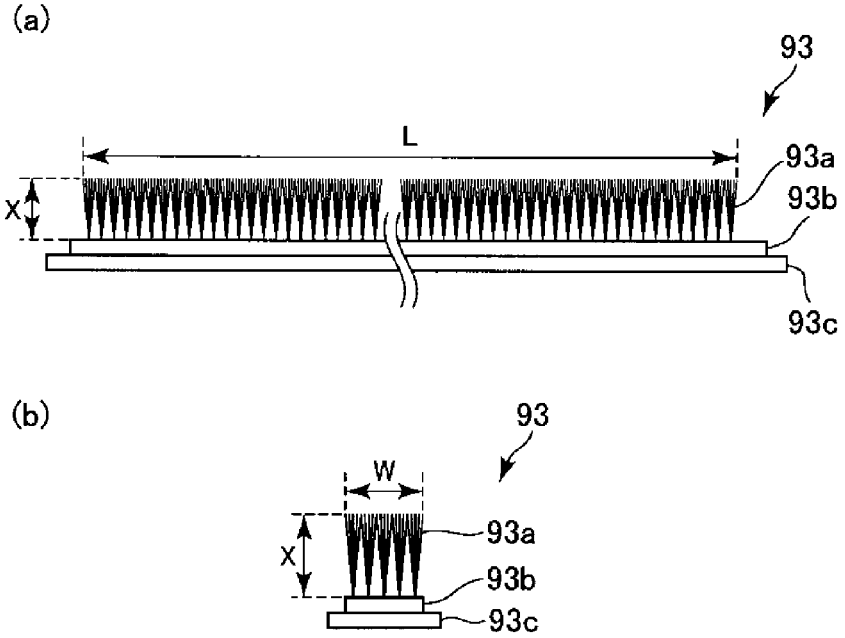
FIG. 4, (a) and (b) are schematic sectional views for illustrating a structure of an electroconductive brush in this embodiment, in which (a) is the schematic sectional view of the electroconductive brush with respect to a horizontal direction to a rotational axis direction of an intermediary transfer belt, and (b) is the schematic sectional view of the electroconductive brush with respect to a perpendicular direction to the rotational axis direction of the intermediary transfer belt.
Figure 5:
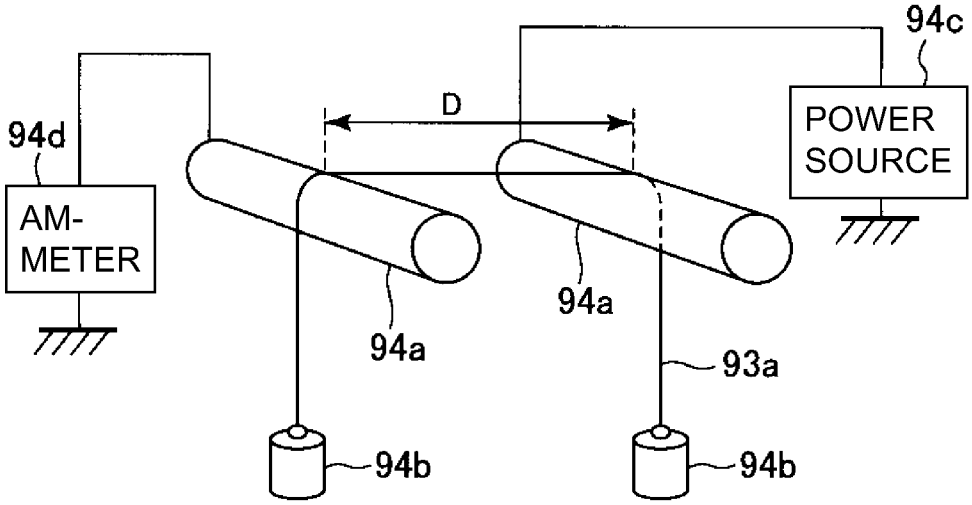
FIG. 5 is a schematic view for illustrating a resistance measuring method of electroconductive fibers of the electroconductive brush in this embodiment.

As shown in FIG. 4, a plurality of electroconductive fibers 93*a* constituting the electroconductive brush 93 which is the auxiliary cleaning member principally contains nylon fibers and use carbon black as the electroconductive agent. The electroconductive fibers 93*a* are $1\times10^{5}$ Ω·cm in resistance value per unit length of a single fiber and are 170T/68F in single fiber fineness. The single fiber fineness in this case means that a single thread is constituted by 68 filament fibers and a weight thereof is 170 T (decitex: the weight corresponding to a length of 10000 m in 170 g).

A resistance measuring method of the electroconductive fiber 93*a* is such that the electroconductive fiber 93*a* to be measured is stretched by two metal rollers 94*a*, each having a diameter of 5 mm, provided with a width D of 10 mm, and a load of a weight 94*b* of 100 g is exerted on each of the two metal rollers 94*a*. In this secondary-transfer, a voltage of 200 V is applied from a power source (voltage source) 94*c* to the electroconductive fiber 93*a* via the metal rollers 94*a*, and a current value at that time is read by an ammeter 94*d*, and then the resistance value (Ω/cm) of the electroconductive fiber 93*a* per 10 mm (1 cm) is calculated. A resistance range of the electroconductive fiber 93*a* may preferably be a range from $1\times10^3$ Ω/cm to $1\times10^7$ Ω/cm from the viewpoint that the slip-through toner is collected.

When the resistance value of the electroconductive fiber 93*a* is lower than $1\times10^3$ Ω/cm, a large current is liable to flow, and from the viewpoint of output accuracy of the high-voltage source 300 in this embodiment, the applied voltage is undesirably less liable to be subjected to constant-current control. On the other hand, when the resistance value of the electroconductive fiber 93*a* is higher than $1\times10^7$ Ω/cm, an attraction force between the collected toner and the electroconductive fibers 93*a* is strengthened, and the toner is not discharged during non-voltage application, so that the toner is accumulated in the electroconductive brush 93 and thus toner collecting power is undesirably lowered.

The electroconductive brush 93 which is the auxiliary cleaning member constituted as a group of the electroconductive fibers 93*a* as described above is constituted as shown in (a) and (b) of FIG. 4. A brush is constituted by the electroconductive fibers 93*a* woven on a base cloth 93*b* constituted by insulating nylon, and the base cloth 93*b* is bonded onto an SUS plate 93*c* of 1 mm in thickness by an electroconductive adhesive. When a rotational axis direction of the intermediary transfer belt 6 is a longitudinal direction and the rotational movement direction is a feeding direction, the electroconductive brush 93 which is the auxiliary cleaning member in this embodiment is as follows.

The electroconductive fibers 93*a* which are 225 mm in longitudinal width L, 5 mm in feeding direction width W, and 5 mm in length X are planted in 5 rows with respect to the feeding direction, thus preparing the electroconductive brush 93. At this time, the electroconductive brush 93 is $1\times10^3$Ω in resistance value Rb and 100 kF/inch$^2$ in density. Further, a free end position of the electroconductive brush 93 is fixedly disposed to have a penetration amount of about 1.0 mm with respect to a (phantom) surface of the intermediary transfer belt 6, and has a difference in peripheral speed relative to the intermediary transfer belt 6. To the electroconductive brush 93, from the high-voltage source 300, a predetermined voltage is applied. A voltage application state to the electroconductive brush 93 is output-controlled and is arbitrarily changeable. The slip-through toner is electrostatically collected during the voltage application, and an electrostatically retaining force does not act during non-voltage application, and therefore the toner collected by the electroconductive brush 93 is discharged onto the intermediary transfer belt 6.

Next, control of the voltage applied to the electroconductive brush 93 will be described specifically.

Figure 6:
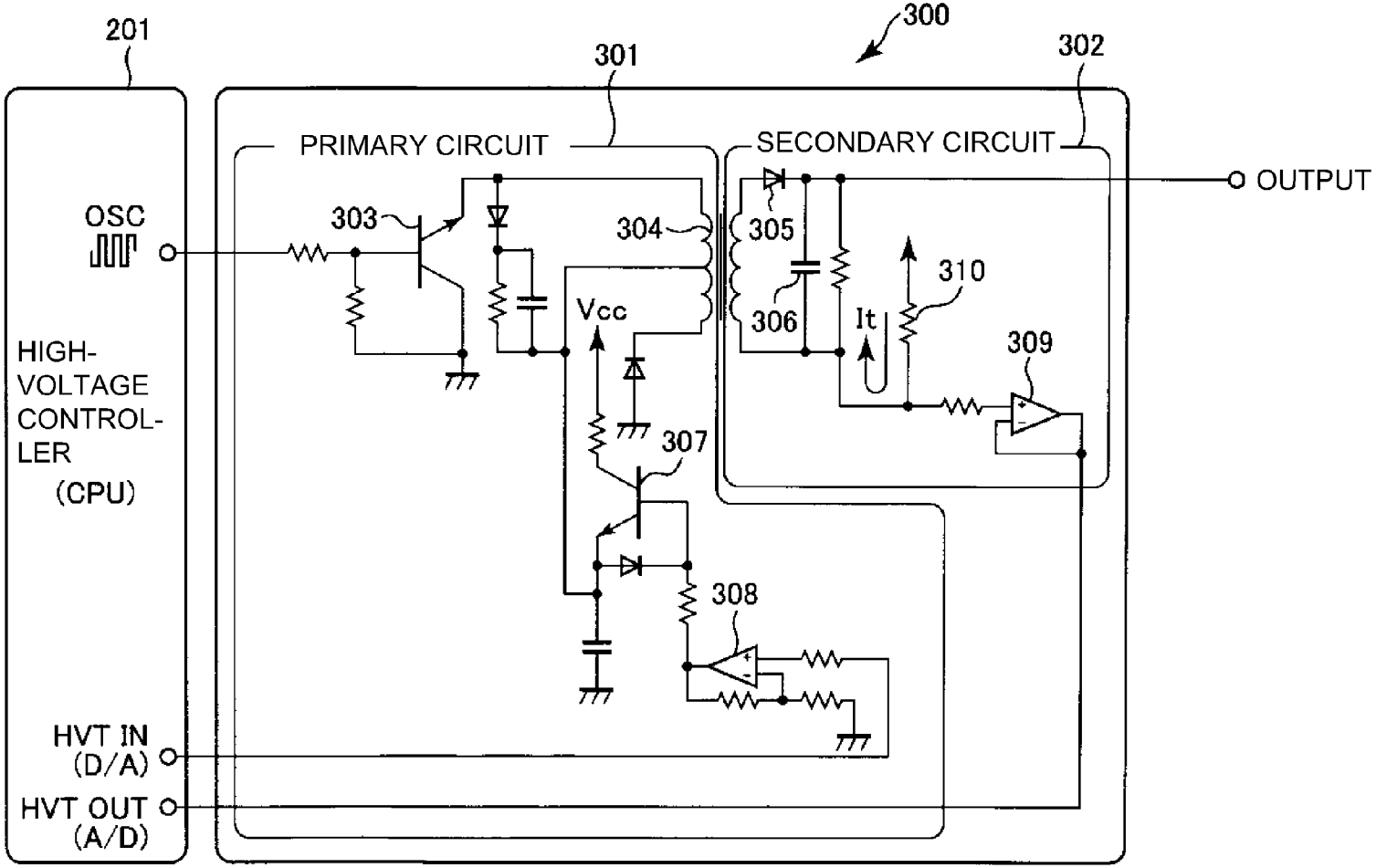
FIG. 6 is a block diagram for illustrating a high-voltage source in this embodiment.

FIG. 6 is a schematic diagram showing the high-voltage source 300 used in this embodiment. The high-voltage source 300 includes a primary high-voltage output circuit 301 and a secondary high-voltage output circuit 302. The secondary high-voltage output circuit 302 includes a current detecting circuit as a output current detecting unit.

In this embodiment, to the electroconductive brush 93 which is the auxiliary cleaning member, the positive voltage is applied. The voltage to be applied to the electroconductive brush 93 is applied from the high-voltage source 300. In the high-voltage source 300, a pulse signal OSC is transmitted from a high-voltage controller (CPU) 201 as a voltage control unit to a transistor 303 in the primary high-voltage output circuit 301. The pulse signal OSC outputted from an inverter transducer 304 via the transistor 303 is rectified by a diode 305 and a capacitor 306 in the secondary high-voltage output circuit 302, and then is outputted to the electroconductive brush 93.

In the high-voltage controller 201, "HVT IN" represents D/A output which is an output of conversion from a digital signal into an analog signal, and "HVT OUT" represents A/D input which is an input of conversion from the analog signal into the digital signal.

A DC level of the high-voltage source 300 is proportional to an emitter voltage of a transistor 307. Further, the outputted "HVT IN" (DC level signal) from the high-voltage source 300 is amplified in an operational amplifier 308 and then is inputted into a base of the transistor 307. Accordingly, an output transfer voltage increases with an increase in "HVT IN". An output current at this time can be detected by obtaining a voltage drop of a resistor 310 (R (Ω)) by the operational amplifier 309.

The high-voltage controller 201 calculates an output current It(A) from the output ("HVT OUT") of the operational amplifier 309 from the following equation:

$$It(A)=(V-\text{"HVT OUT"})(V)/R(\Omega)$$

On the basis of the value of It(A), the value of "HVT IN" (D/A) is controlled by the high-voltage controller (CPU) 201, the constant-current control is carried out.

The voltage to be applied to the electroconductive brush 93 which is the auxiliary cleaning member may preferably be constituted so as to be subjected to the constant-current control in a range from 1 μA to 8 μA. As a result of study by the present inventors, when the current is less than 1 μA, a sufficient electrostatic collecting force does not act on the slip-through toner. As a result, all the slip-through toner cannot be collected, and therefore a cleaning defect is undesirably caused to occur. On the other hand, when the voltage is constant-current-controlled at the current of 10 μA or more, the slip-through toner is positively charged by electric discharge in the electroconductive brush 93 and then reaches the primary-transfer portion N1. The slip-through toner is transferred back onto the photosensitive drum 1Y at the first primary-transfer portion N1Y and then is collected in the photosensitive drum cleaning unit 4Y disposed on the photosensitive drum 1Y. In this case, as described above, the number of times of the transfer of the residual toner onto the photosensitive drum 1Y becomes large, and the photosensitive drum 1Y is concentratedly damaged, so that there is an undesirable possibility that a degree of the damage is accumulated. Therefore, a constitution in which the voltage to be applied to the electroconductive brush 94 is constant-current-controlled in the range from 1 μA to 8 μA is suitable, and in this embodiment, the current is set at 4 μA.

Figure 7:
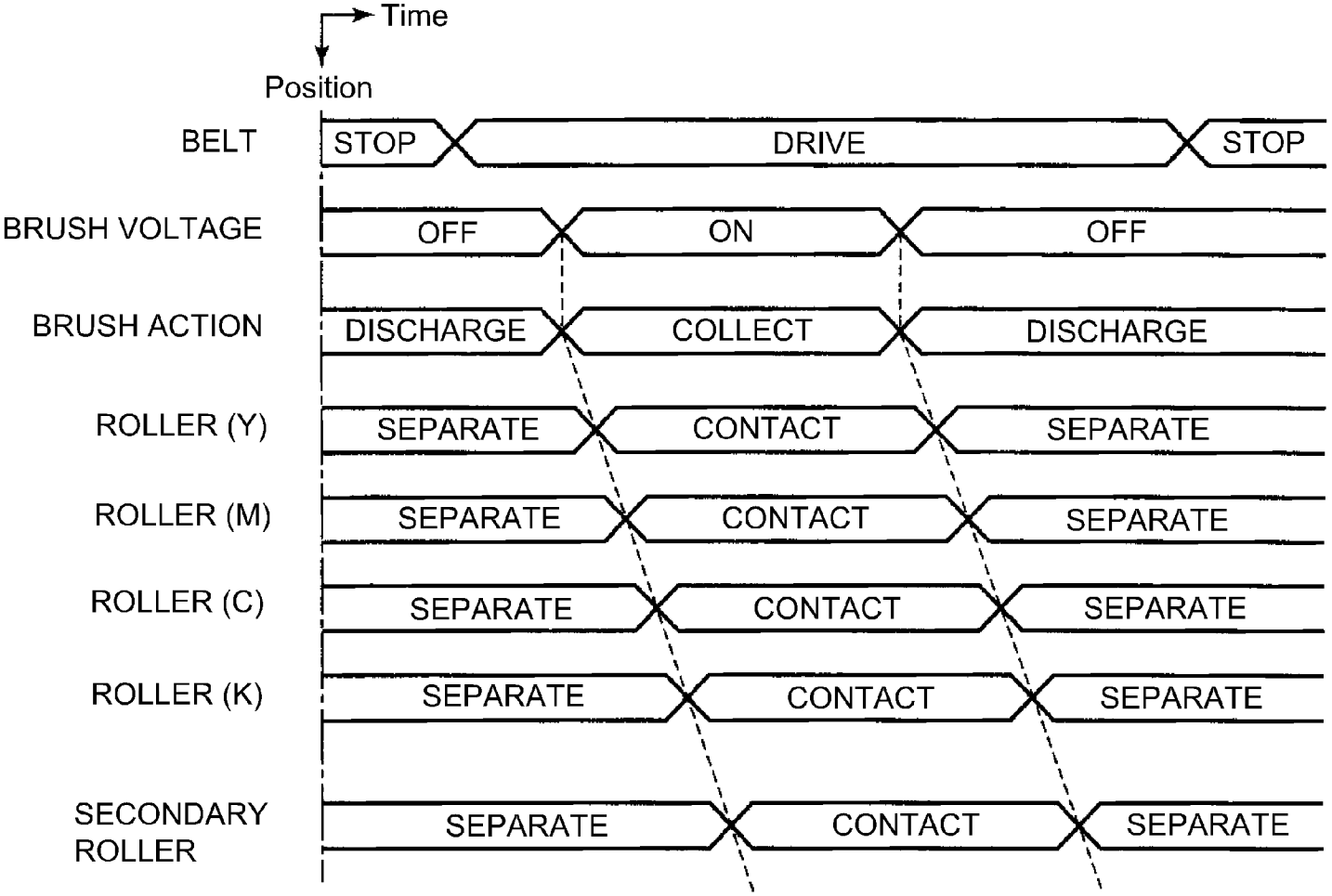
FIG. 7 is a timing chart for illustrating switching timing between a state of an auxiliary cleaning member and a contact-and-separation state of each of the primary-transfer rollers and a secondary-transfer roller in this embodiment.

Next, voltage application timing to the electroconductive brush 93 will be specifically described using an operation sequence shown in a diagram of FIG. 7.

The operation sequence shown in FIG. 7 shows a rotational drive state of the intermediary transfer belt 6, a voltage application state to the electroconductive brush 93 which is the auxiliary cleaning member, a toner collecting and discharging state of the electroconductive brush 93, a contact-and-separation state of each of the primary-transfer rollers, and a contact-and-separation state of the secondary-transfer roller 8. The operation sequence of FIG. 7 is as follows in the order from above to below. The first row shows the drive state of the intermediary transfer belt 6. The second row shows the voltage application state to the electroconductive brush 93. The third row shows the toner collecting and discharging state of the electroconductive brush 93. The fourth row shows the contact-and-separation state of the primary-transfer roller 7Y. The fifth row shows the contact-and-separation state of the primary-transfer roller 7M. The sixth row shows the contact-and-separation state of the primary-transfer roller 7C. The seventh row shows the contact-and-separation state of the primary-transfer roller 7K. The eighth row shows the contact-and-separation state of the secondary-transfer roller 8. The contact-and-separation state between the intermediary transfer belt 6 and each of the photosensitive drums 1Y, 1M, 1C, 1K is controlled by moving each of the primary-transfer rollers 7Y, 7M, 7C, 7K toward and away from the intermediary transfer belt 6 by the controller 201. Further, by the controller 201, the secondary-transfer roller 8 is moved toward and away from the intermediary transfer belt 6.

When the image forming operation is started, first, the drive of the intermediary transfer belt 6 is started. At this time, the voltage is not applied to the electroconductive brush 93. For this reason, on the intermediary transfer belt 6, the slip-through toner slipped through the blade 91 and the toner collected by the electroconductive brush 93 are discharged and carried. Thereafter, in synchronism with start of the image formation of each of the process cartridges PY, PM, PC, PK, the associated one of the primary-transfer rollers 7Y, 7M, 7C, 7K is successively contacted to the associated one of the photosensitive drums 1Y, 1M, 1C, 1K. In this embodiment, as shown in FIG. 7, when the primary-transfer rollers 7Y, 7M, 7C, 7K are contacted to the photosensitive drums 1Y, 1M, 1C, 1K, control is effected so that the slip-through toner and the discharged toner do not exist on the intermediary transfer belt 6 at the primary-transfer portion N1Y. In consideration of a movement time from the electroconductive brush 93 to the primary-transfer portion N1Y at a certain point on the intermediary transfer belt 6, the voltage application to the electroconductive brush 93 is started. By the voltage application to the electroconductive brush 93 which is the auxiliary cleaning member, the toners on the intermediary transfer belt 6 are collected. By employing such a constitution, the discharged toner and the slip-through toner on the intermediary transfer belt 6 are not moved to the photosensitive drums 1Y, 1M, 1C, 1K.

Further, in synchronism with start of the image formation of each of the process cartridges PY, PM, PC, PK, the secondary-transfer roller 8 is contacted to the intermediary transfer belt 6. In this embodiment, as shown in FIG. 7, in consideration of a movement time from the electroconductive brush 93 to the secondary-transfer portion N2 when the secondary-transfer roller 8 is contacted to the intermediary transfer belt 6, the voltage application to the electroconductive brush 93 is started so that the discharged toner does not exist on the intermediary transfer belt 6 at the secondary-transfer portion N2. That is, the voltage is applied to the electroconductive brush 93, and then the secondary-transfer roller 8 is contacted to the intermediary transfer belt 6. As a result, the toner on the intermediary transfer belt 6 is collected by the electroconductive brush 93, and thereafter the secondary-transfer roller 8 is contacted to the intermediary transfer belt 6, and therefore no residual toner exists at the secondary-transfer portion N2. By employing such a constitution, the discharged toner discharged on the intermediary transfer belt 6 and the slip-through toner slipped through the collect blade are not moved to the secondary-transfer roller 8.

During the image forming operation, the voltage is continuously applied to the electroconductive brush 93, and as described above, the cleaning of the residual toner and the collection of the slip-through toner are carried out. For that reason, during the image formation, the slip-through toner does not reach the primary-transfer portions N1 and the secondary-transfer portion N2.

At the time of the end of the image formation, in synchronism with the end of the image formation at each of the PY, PM, PC, PK, the associated one of the primary-transfer rollers 7Y, 7M, 7C, 7K is successively separated from the associated one of the photosensitive drums 1Y, 1M, 1C and 1K. In this embodiment, as shown in FIG. 7, in consideration of the movement time from the electroconductive brush 93 to the primary-transfer portion N1, the voltage application to the electroconductive brush 93 is ended so that the discharged toner developed on the intermediary transfer belt 6 reaches the primary-transfer portion N1 after the primary-transfer rollers 7Y, 7M, 7C, 7K are separated from the photosensitive drums 1Y, 1M, 1C, 1K.

Further, in synchronism with the end of the image formation at the process cartridges PY, PM, PC, PK, the secondary-transfer roller 8 is separated from the intermediary transfer belt 6. Thereafter, the drive of the intermediary transfer belt 6 is stopped, so that the image forming operation is ended. In this embodiment, the secondary-transfer roller 8 is separated from the intermediary transfer belt 6 before the discharged toner discharged on the intermediary transfer belt 6 reaches the secondary-transfer portion N1. In consideration of the rotation movement time of the intermediary transfer belt 6 from the electroconductive brush 93 to the secondary-transfer portion N2, the voltage application to the electroconductive brush 93 is ended at timing shown in FIG. 7. Thereafter, the drive of the intermediary transfer belt 6 is stopped, and then the image forming operation is completed.

As described above, ON/OFF of the voltage application to the electroconductive brush 93 is carried out in a period in which the intermediary transfer belt 6 is driven. This is because when the voltage is not applied to the electroconductive brush 93, the collected toner is discharged on the intermediary transfer belt 6, so that a lowering in collecting performance due to toner accumulation in the electroconductive brush 93.

Action in this Embodiment

In the above-described constitution, a cleaning method of removing the residual toner will be described with reference to FIG. 3. As described above, most of the residual toner is mechanically scraped off by the blade 91 disposed upstream of the intermediary transfer belt cleaning unit 9 with respect to the rotational movement direction of the intermediary transfer belt 6, and then is collected in the accommodating member 92. The action by the blade 91 is not electrostatic collection but is mechanical scraping-off, and therefore there is no need to discharge the collected toner, so that the action has no influence on the downtime.

On the other hand, there is a case where, on the surface of the intermediary transfer belt 6, a contaminant is included during manufacturing and during use of the image forming apparatus, resulting in a small unevenness. At a portion where the small unevenness exists, a close contact property between the blade 91 and the intermediary transfer belt 6 is not sufficient. For this reason, the residual toner passes through the blade 91, so that the slip-through toner generates in some cases. Further, there is a case where a coating layer is provided as a surface layer of the intermediary transfer belt 6 in order to improve a secondary-transfer property. In this case, a friction coefficient between the blade 91 and the intermediary transfer belt 6 becomes large, and therefore damage on the blade 91 due to the unevenness of the intermediary transfer belt 6 described above is liable to proceed. For that reason, the close contact property between the blade 91 and the intermediary transfer belt 6 is further lowered. As a result, a problem such that the residual toner in the neighborhood of the unevenness slips through the blade 91 and thus a good cleaning property cannot be maintained is liable to arise.

In this embodiment, as described above, most of the residual toner is mechanically scraped off by the blade 91 disposed upstream of the intermediary transfer belt cleaning unit 9 with respect to the rotational movement direction of the intermediary transfer belt 6. However, there is also a case where the residual toner in a slight amount slips through the blade 91.

When the slip-through toner is left as it is, the cleaning defect occurs, and therefore in this embodiment, the good cleaning property is maintained by applying a voltage to the above-described electroconductive brush 93 thereby to electrostatically collect the slip-through toner. In this embodiment, the electroconductive brush 93 is used as the auxiliary cleaning member, but a similar effect can be obtained by also an electroconductive roller, so that a constitution using the electroconductive roller may also be used.

As described above, collection of the slip-through toner is not carried out when the primary-transfer rollers 7Y, 7M, 7C, 7K are separated from the photosensitive drums 1Y, 1M, 1C, 1K. The toner discharged from the electroconductive brush 93 onto the intermediary transfer belt 6 reaches again the blade 91 and then is mechanically scraped off and is collected into the accommodating member 92. The discharged toner discharged on the intermediary transfer belt 6 is scattered by being passed through the electroconductive brush 93, so that compared with when the discharged toner is slips through the blade 91, a height of the toner is decreased. For that reason, the discharged toner is easily scraped off, so that the discharged toner discharged on the intermediary transfer belt 6 does not slip through again the blade 91.

Further, during the image formation, the slip-through toner collection is made, and therefore there is no opportunity that the residual toner contacts the photosensitive drums 1Y, 1M, 1C, 1K, so that the damage on the photosensitive drums 1Y, 1M, 1C, 1K can be prevented. Further, there is no opportunity that the residual toner contacts the secondary-transfer roller 8, so that contamination of the transfer material S can be prevented.

As described above, the discharge of the toner from the electroconductive brush 93 is carried out during the pre-rotation and the post-rotation in the image formation, and therefore there is no occurrence of the downtime due to the toner discharge. Further, also as described above, most of the residual toner is mechanically scraped off by the blade 91 disposed in the upstream side of the rotational movement direction of the intermediary transfer belt 6, so that the amount of the toner which slipped through the blade 91 and reaches the electroconductive brush 93 is slight. Accordingly, by carrying out the discharge during the pre-rotation and the post-rotation, a lowering in collecting performance due to the toner accumulation into the electroconductive brush 93 can be sufficiently prevented, and therefore there is no need to provide particular downtime for the toner discharge.

By employing the above-described constitution, it is possible to provide the image forming apparatus 100, capable of achieving cleaning of the intermediary transfer belt 6, in which a degree of the damage on the photosensitive drum 1 is reduced while ensuring the cleaning property.

Embodiment 2

In a constitution of an image forming apparatus 100 applied in this embodiment, members or portions similar to those in Embodiment 1 are represented by the same reference numerals or symbols and will be omitted from description. Also with respect to the electroconductive brush 93 which is the auxiliary cleaning member used as the residual toner charging unit, a dimension and arrangement are similar to those in Embodiment 1. Further, also the contact-and-separation operation between the primary-transfer roller 7 and the photosensitive drum 1 during the image formation and before and after the image formation is similar to that in Embodiment 1. The image forming apparatus 100 in this embodiment is different from Embodiment 1 in that the secondary-transfer roller 8 is not provided with the contact-and-separation mechanism.

Feature in this Embodiment

With respect to an example of a structure of the image forming apparatus 100 in which the secondary-transfer roller 8 is not provided with the contact-and-separation mechanism, an operation sequence will be described using a diagram of FIG. 8.

Figure 8:
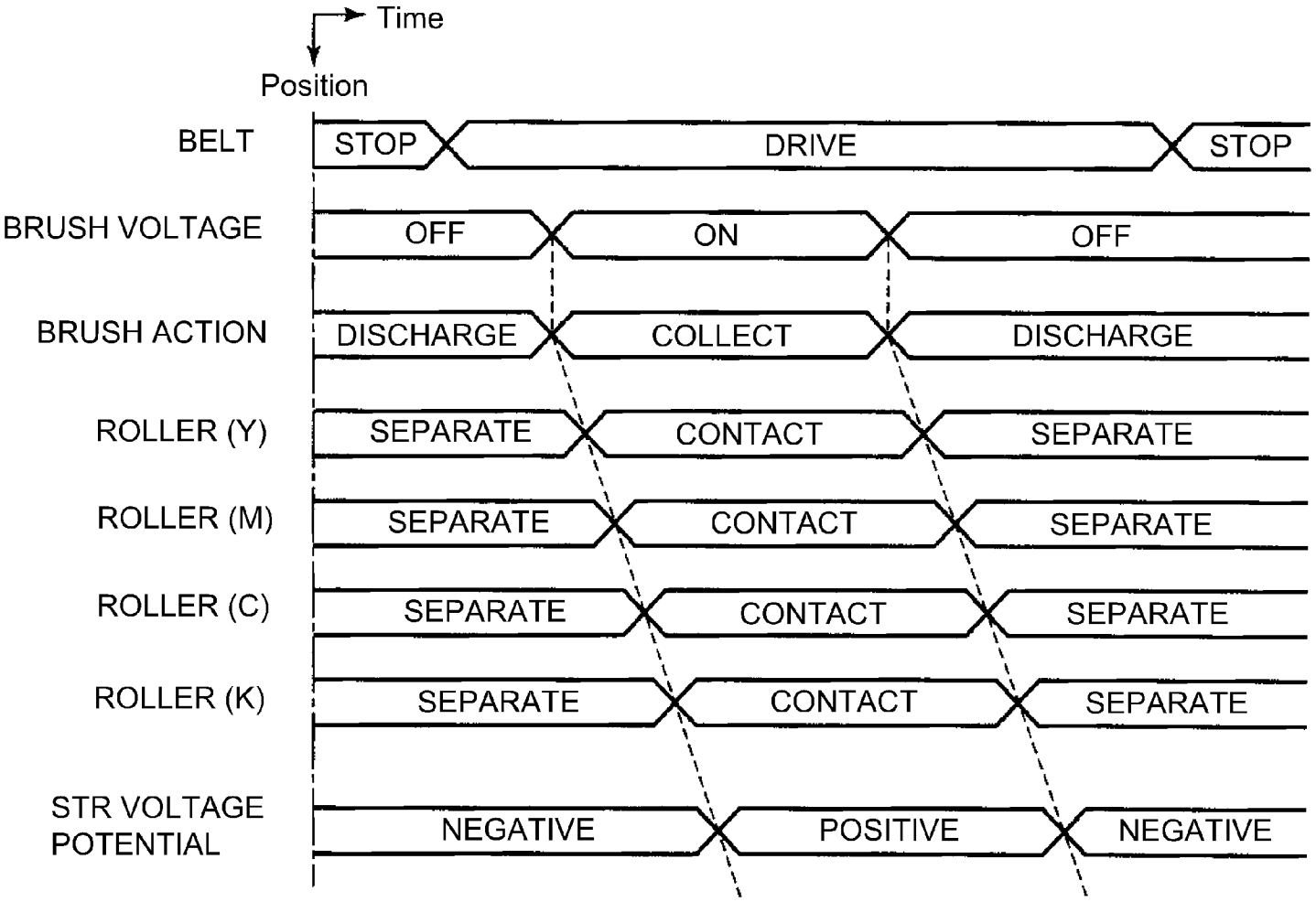
FIG. 8 is a timing chart for illustrating switching timing between a state of an auxiliary cleaning member and a polarity of a voltage applied to a secondary-transfer roller in another embodiment.

The operation sequence shown in FIG. 8 shows a drive state of the intermediary transfer belt 6, a voltage application state to the electroconductive brush 93 which is the auxiliary cleaning member, a toner collecting and discharging state of the electroconductive brush 93, a contact-and-separation state of each of the primary-transfer rollers, and a polarity of a voltage to be applied to the secondary-transfer roller 8.

As described above in Embodiment 1, the toner collected by the electroconductive brush 93 which is the auxiliary cleaning member is discharged onto the intermediary transfer belt 6 before and after the image formation. When the discharge toner and the slip-through toner on the intermediary transfer belt 6 reach the secondary-transfer portion N2 and contact the secondary-transfer roller 8 as they are, a part of the toners is deposited on the secondary-transfer roller 8. In this state, when the image formation is effected, the toner deposited on the secondary-transfer roller 8 is deposited on the back surface of the transfer material S, thus undesirably contaminating the transfer material S therewith. Therefore, in this embodiment, the voltage of the same polarity as the polarity of the toner is applied to the secondary-transfer roller 8, and thus the toner deposition onto the secondary-transfer roller 8 is prevented when the slip-through toner or the like exists at the secondary-transfer portion N2, so that the above problem is solved, the toner used in this embodiment possesses the negative polarity, and therefore by applying the negative voltage to the secondary-transfer roller 8, the toner deposition onto the secondary-transfer roller 8 is prevented.

Operation in this Embodiment

When the image forming operation is started, first, the drive of the intermediary transfer belt 6 is started. At this time, the voltage is not applied to the electroconductive brush 93. For this reason, on the intermediary transfer belt 6, the slip-through toner slipped through the blade 91 and the toner collected by the electroconductive brush 93 are discharged and carried. Thereafter, similarly as in Embodiment 1, in synchronism with start of the image formation of each of the process cartridges PY, PM, PC, PK, the voltage is applied to the electroconductive brush 93. In this embodiment, as shown in FIG. 8, when the discharged toner exists at the voltage of the negative polarity which is the same as the polarity of the toner is applied to the secondary-transfer roller 8. By employing such a constitution, the discharged toner is prevented from being deposited onto the secondary-transfer roller 8.

Thereafter, the toner discharge is ended by starting the voltage application to the electroconductive brush 93. In consideration of a movement time from the electroconductive brush 93 to the secondary-transfer portion N2, the application of the positive voltage to the secondary-transfer roller 8 for transferring the toner image onto the transfer material S is started at this timing.

During the image forming operation, the voltage is continuously applied to the electroconductive brush 93, and as described above, the cleaning of the residual toner and the collection of the slip-through toner are carried out.

At the time of the end of the image formation, similarly as in Embodiment 1, in synchronism with the end of the image formation at each of the PY, PM, PC, PK, the voltage application to the electroconductive brush 93 is ended, so that the toner is started to be discharged onto the intermediary transfer belt 6. In consideration of the movement time from the electroconductive brush 93 to the secondary-transfer portion N2, the negative voltage application to the secondary-transfer roller 8 for preventing the toner deposition onto the secondary-transfer roller 8 is started at this timing. By employing such a constitution, the discharged toner is prevented from being deposited onto the secondary-transfer roller 8. Thereafter, the drive of the intermediary transfer belt 6 is stopped, so that the image forming operation is ended.

By employing the constitution described above, even in the case where the residual toner, the slip-through toner and the discharged toner contact the secondary-transfer roller 8 without performing the separation between the secondary-transfer roller 8 and the intermediary transfer belt 6, it is possible to prevent contamination of the transfer material S. Further, similarly as in Embodiment 1, it is possible to provide the image forming apparatus, capable of achieving the cleaning of the intermediary transfer belt 6, in which the degree of the damage on the photosensitive drum 1 is reduced while ensuring the cleaning property.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 206802/2013 filed Oct. 1, 2013, which is hereby incorporated by reference.

What is claimed is:

1. An image forming apparatus comprising:

an image bearing member for bearing a toner image;

an intermediary transfer member which is movable and onto which the toner image is to be primary-transferred from said image bearing member at a primary transfer portion;

a controller; and a cleaning unit for removing a residual toner remaining on said intermediary transfer member without being secondary-transferred from said intermediary transfer member onto a transfer material at a secondary transfer portion, wherein said cleaning unit includes a cleaning member for collecting the residual toner, and a charging member, which is provided downstream of the cleaning member and upstream of said image bearing member with respect to a movement direction of said intermediary transfer member, for electrically charging the residual toner, and an accommodating member for accommodating the residual toner, the cleaning member and the charging member each being in contact with said intermediary transfer member, wherein said controller is capable of executing an operation in a discharging mode in which the toner is discharged from the charging member onto said intermediary transfer member, and wherein when the operation in the discharging mode is executed, said cleaning unit collects the toner, discharged from the charging member on said intermediary transfer member, by the cleaning member and then accommodates the collected toner in the accommodating member.

2. An image forming apparatus according to claim 1, wherein said cleaning member is provided downstream of the secondary-transfer portion and upstream of the primary-transfer portion with respect to a movement direction of said intermediary transfer member.

3. An image forming apparatus according to claim 1, wherein said controller applies a voltage of a predetermined polarity to the charging member when the charging member charges the residual toner, and applies a voltage of an opposite polarity to the predetermined polarity to the charging member when the operation in the discharging mode is executed.

4. An image forming apparatus according to claim 3, wherein the residual toner charged to the predetermined polarity by the charging member is moved to said intermediary transfer member or said image bearing member simultaneously with the toner image primary-transferred from said image bearing member onto said intermediary transfer member.

5. An image forming apparatus according to claim 3, further comprising a secondary transfer member contactable to said intermediary transfer member at the secondary transfer portion, wherein when the operation in the discharging mode is executed, the toner discharged on said intermediary transfer member is passed through a position opposing said secondary transfer member in a state in which the voltage of the opposite polarity is applied to said secondary transfer member and in which said secondary transfer member is separated from said intermediary transfer member, and then is caused to reach the cleaning member.

6. An image forming apparatus according to claim 1, wherein when the operation in the discharging mode is executed, the toner discharged on said intermediary transfer member is passed through a position opposing said image bearing member in a state in which said intermediary transfer member and said image bearing member are separated from each other, and then is caused to reach the cleaning member.

7. An image forming apparatus according to claim 6, wherein said image bearing member is provided in plural.

8. An image forming apparatus according to claim 1, further comprising a secondary transfer member contactable to said intermediary transfer member at the secondary transfer portion, wherein when the operation in the discharging mode is executed, the toner discharged on said intermediary transfer member is passed through a position opposing said secondary transfer member in a state in which said secondary transfer member is separated from said intermediary transfer member, and then is caused to reach the cleaning member.

9. An image forming apparatus according to claim 1, wherein the cleaning member is a blade-shaped elastic member.

10. An image forming apparatus according to claim 9, wherein the charging member includes a plurality of electroconductive fibers which are fixedly provided.

11. An image forming apparatus according to claim 10, wherein said intermediary transfer member is an endless intermediary transfer belt including a coating layer at a surface thereof.

12. An image forming apparatus according to claim 10, wherein the plurality of electroconductive fibers holds a part of the residual toner when the residual toner is charged.

* * * * *